US005454211A

United States Patent [19]

Ziegler et al.

[11] Patent Number: 5,454,211

[45] Date of Patent: Oct. 3, 1995

[54] MULTILEVEL CARTON PACKAGING PROCESS

[75] Inventors: Kelly W. Ziegler; Allen L. Olson, both of Crosby, Minn.

[73] Assignee: Riverwood International Corporation, Denver, Colo.

[21] Appl. No.: 124,266

[22] Filed: Sep. 20, 1993

[51] Int. Cl.[6] ..... B65B 43/24

[52] U.S. Cl. ..... 53/458; 53/448; 53/475; 53/252; 53/534; 53/566

[58] Field of Search ..... 229/120.21, 120.28, 229/120.32; 414/791; 198/374, 475.1, 418.3, 418.4; 53/447, 475, 534, 537, 540, 566, 156, 157, 152, 153, 237, 247, 251, 252, 48.5, 240, 246, 448, 452, 456, 457, 458, 539, 543

[56] References Cited

U.S. PATENT DOCUMENTS

| | | | |
|---|---|---|---|
| 2,646,201 | 7/1953 | Meinhardt | 229/120.32 |
| 3,029,711 | 4/1962 | Griese | 53/458 X |
| 3,039,248 | 7/1962 | Jones | 53/537 X |
| 3,050,228 | 8/1962 | Lane | 229/120.32 |
| 3,201,912 | 8/1965 | Wozniak . | |
| 3,275,220 | 9/1966 | Hubbard | 229/120.32 X |
| 3,340,672 | 9/1967 | Kayser | 53/153 |
| 3,826,058 | 7/1974 | Preisig | 55/475 X |
| 3,850,282 | 11/1974 | Calvert et al. . | |
| 3,861,530 | 1/1975 | Calvert . | |
| 3,881,298 | 5/1975 | Griner et al. | 53/537 |
| 3,941,236 | 3/1976 | Hagedorn | 53/537 X |
| 4,237,673 | 12/1980 | Calvert et al. | 53/251 X |
| 4,421,229 | 12/1984 | Pan et al. | 229/120.32 X |
| 4,862,677 | 9/1989 | Roberts et al. | 53/246 X |

*Primary Examiner*—John Sipos
*Assistant Examiner*—Daniel Moon
*Attorney, Agent, or Firm*—Anthony G. Eggink

[57] ABSTRACT

A method to package stacked article groups utilizing packaging sleeves having a divider or base member mounted therein. At least one open end of each packaging sleeve is exposed during travel on a conveyor whereby a stream of articles within reach of the moving packaging sleeves are directed below and above the divider members of the open ended sleeves before closure.

20 Claims, 4 Drawing Sheets

MULTILEVEL CARTON PACKAGING PROCESS

BACKGROUND OF THE INVENTION

This invention relates to the packaging of stacked articles to form stacked article units. Particularly, this invention relates to methods of packaging stacked articles utilizing a multilevel carton packaging process wherein packaging cartons are provided having a divider member mounted therein.

The packaging of stacked articles, such as beverage and food containers and the like, has been found to be an economical and well accepted means to distribute products. These benefits extend to both the distributor and to the consumer. The primary limitation to the distribution of stacked articles, such as stacked beverage cans, has been the ability to form and package such stacked article groups in a fast and economical manner. The methods of this invention utilize multilevel packaging cartons having a divider sheet mounted therein to provide such stacked article groups.

SUMMARY OF THE INVENTION

The present invention provides a method of packaging stacked articles utilizing multilevel packaging cartons having a divider sheet mounted therein. The method comprises providing a supply of packaging cartons, each having at least one divider or base member mounted therein. The packaging cartons are positioned on a moving conveyor so that at least one end of the packaging cartons is exposed to provide access to the carton interior and to expose the divider member. Simultaneously, first and second streams of articles are provided within reach of the opened packaging cartons so that the articles may be directed below and above the divider member in each carton structure. Finally, the packaging cartons are closed to provide a stream of stacked article packages.

These and other benefits will become clear from the following description by reference to the drawings.

DESCRIPTION OF THE PREFERRED EMBODIMENT

Figure 1:
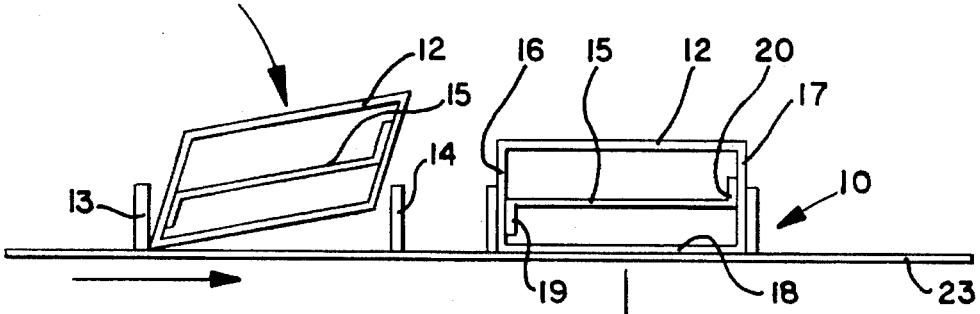
FIGS. 1 and 2 are flow diagrams showing the method of this invention.

FIG. 1 shows a flow diagram of the packaging method of the present invention wherein a supply of multilevel packaging cartons 12 are provided having a divider member 15 mounted therein. The packaging cartons 12 are provided in a magazine 11, for example, wherein a plurality of flat and folded packaging cartons or sleeves 12 are positioned above or within reach of conveyor 23. The flat and folded packaging cartons 12 are removed from the magazine 11 and positioned onto moving conveyor 23 whereby the open ends of the sleeve are faced outwardly or perpendicular to the direction of travel of the conveyor 23.

Figure 2:
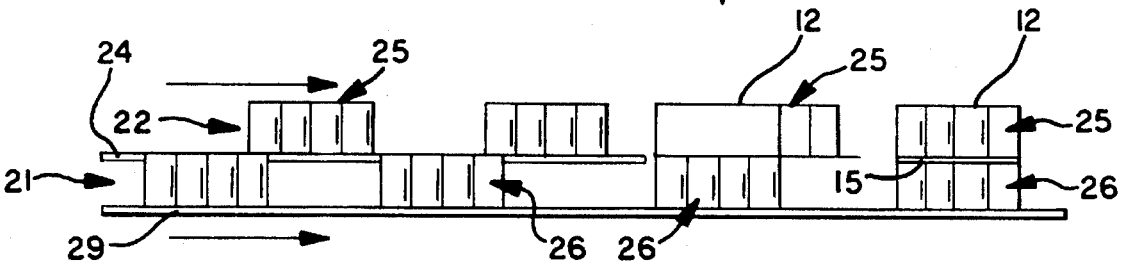
Figure 3:
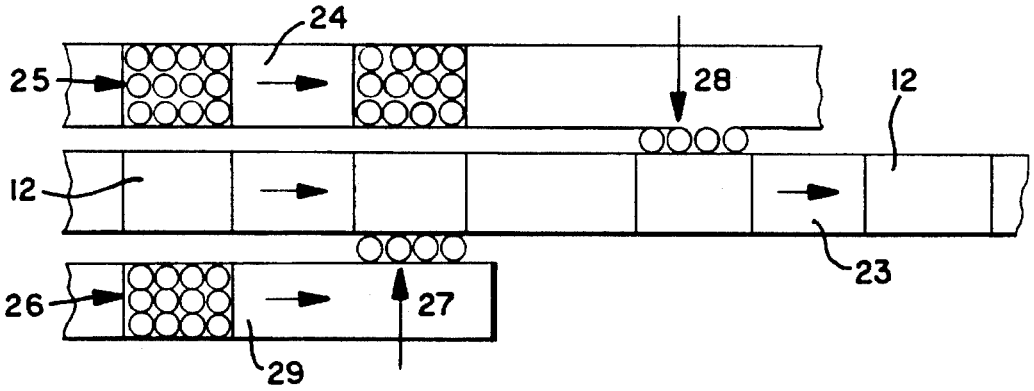
FIG. 3 is a flow diagram showing an alternate method of this invention.

As shown in FIGS. 2 and 3, first and second streams of preselected article groups 21 and 22 are moved on conveyors 29 and 24 which are positioned adjacent the conveyor 23 providing the packaging cartons 12. The article group conveyors 24 and 29 are positioned vertically and spacially apart whereby the first stream of article groups 26 is adjacent the bottom 18 of the cartons 12 and the second stream of article groups 25 is adjacent the divider base 15 of the cartons 12. Alternately, the first and second streams 21 and 22 of article groups 26 and 25 are directed into the packaging cartons 12 through its open ends. It is preferred that the first stream 21 is directed into the carton sleeves so that the divider sheet 12 is supported to subsequently receive the second stream 22 of article groups 25. Finally, the packaging cartons 12 are closed via a gluing step or a carton locking step, as is known in the art.

FIG. 3 particularly shows the method wherein the first and second streams of article groups 26 and 25 are provided on opposite sides of conveyor 23 and whereby the respective streams are directed into the carton structures 12 from opposing sides and into the open ends of the cartons 12. In other words, the spacially positioned first and second streams of article groups 26 and 25 are directed adjacent the opposing sides of conveyor 23 which moves the open ended cartons 12. As shown, pushing mechanisms 27 and 28 are utilized to perpendicularly and sequentially move the article groups 26 and then the article groups 25 into the cartons 12. Alternatively, the conveyors 25 and 26 may be positioned on one side of the carton conveyor 23 whereby the conveyor 25 is positioned above conveyor 26.

Figure 4:
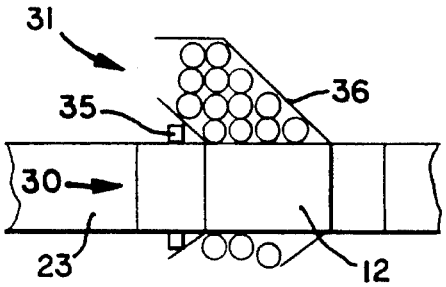
FIG. 4 is a flow diagram showing another method of this invention.

FIG. 4 shows a stream 30 of multilevel carrier cartons 12 on conveyor 23 whereby a stream of articles 31 is directed angularly into the open sides of the cartons 12. Alternatively, a plurality of streams 31 may be utilized in this process whereby opposing, adjacent and streams at various heights may be used to direct articles or article groups angularly into the passing open sided carton structures 12. The tangential or angular movement of articles into carton sleeve ends is known in the packaging art and may utilize movable flight bar ends and cooperating guide rail structures 36.

Figure 5:
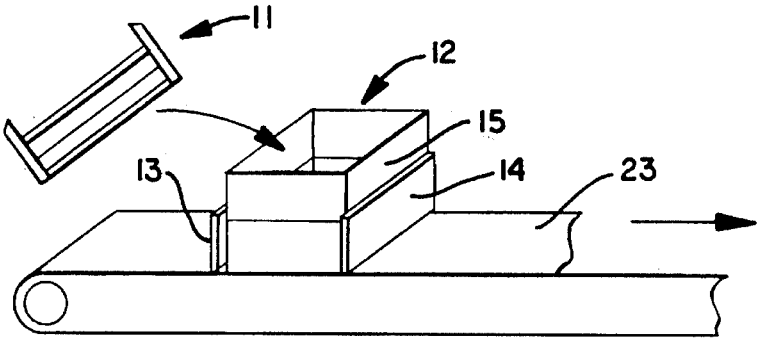
FIGS. 5 and 6 are flow diagrams further showing the methods of this invention.
Figure 6A:
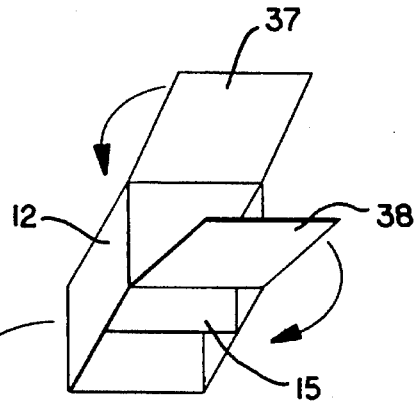
FIG. 6*d* shows a carton to be filled by the method.
Figure 6:
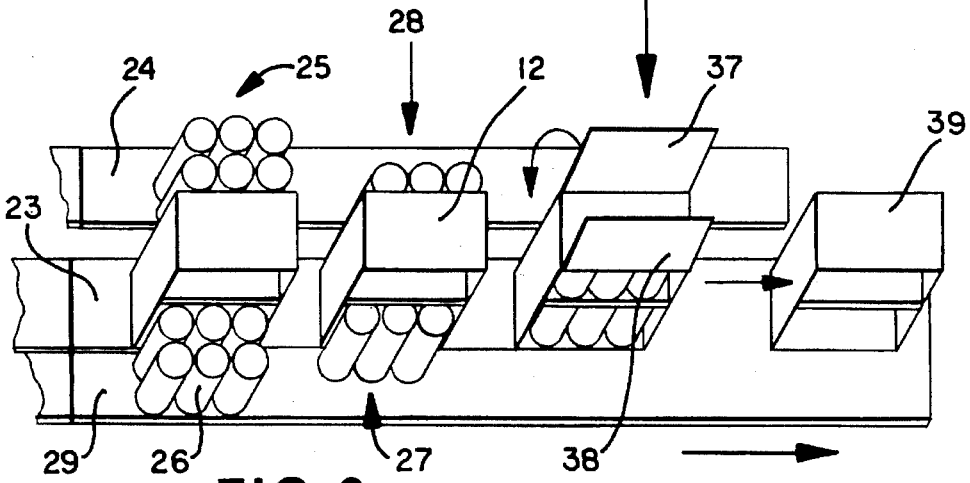

FIGS. 5 and 6 show the multilevel carton structures 12 being placed on conveyor 23 from a carton source 11. The carton structures 23 are shown positioned between flight bars 13 and 15 and although the multilevel cartons 12 are shown to have a single divider base 15 to define the levels within carton 12, a plurality of such divider bases may be utilized in the processes of this invention. As further shown in FIG. 6, the conveyors 29 and 26, which travel at different elevations with respect to the carton conveyor 23, move article groups 26 and 25, respectively, and which are moved and slid into the open cartons 12 by means of pushing devices 27 and 28. Thereafter, the flaps 37 and 38 are closed by known means to form a completed stacked article carrier 39.

Figure 7:
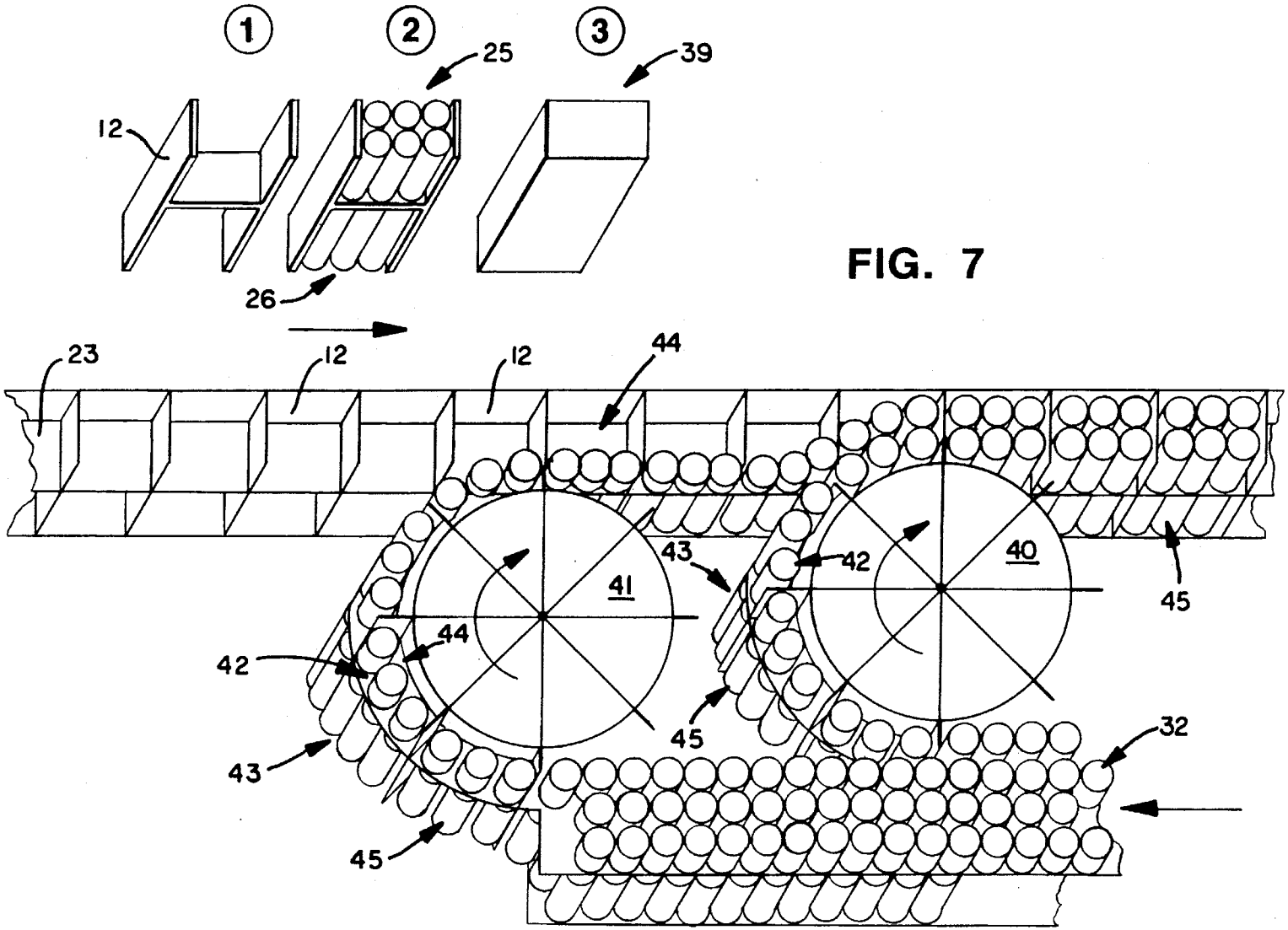
FIG. 7 is a perspective process flow diagram showing another method of the invention.

FIG. 7 shows a method of loading multilevel carton structures 12 by utilizing starwheels 40 and 41. As shown, a stream of carton structures 12 are moved on conveyor 23 adjacent to which starwheels 40 and 41 are positioned. A stream of articles 32 is shown having an upper level and a lower level of articles which are, respectively, entrapped by upper pockets 42 and lower pockets 43 of the starwheels which separate the stream of articles 32 into upper article groups 44 and lower article groups 25. The pockets 42 and 43 of the respective starwheels have predetermined dimension whereby a single layer of articles, as shown, is placed into the multilevel cartons 12. As known in the art, stripper bars are provided for use with the starwheels to ensure proper entry of the article group layers 44 and 45 into the cartons 12. Subsequent to filling the multilevel cartons 12, the packages are closed via known means to provide a stream of completed stacked article carriers 39. It is within the purview of this invention to also utilize and operate the starwheels in a vertical rather then a horizontal manner whereby the article layers 44 and 45 may be dropped into the tops of the opened cartons 12.

Figure 8:
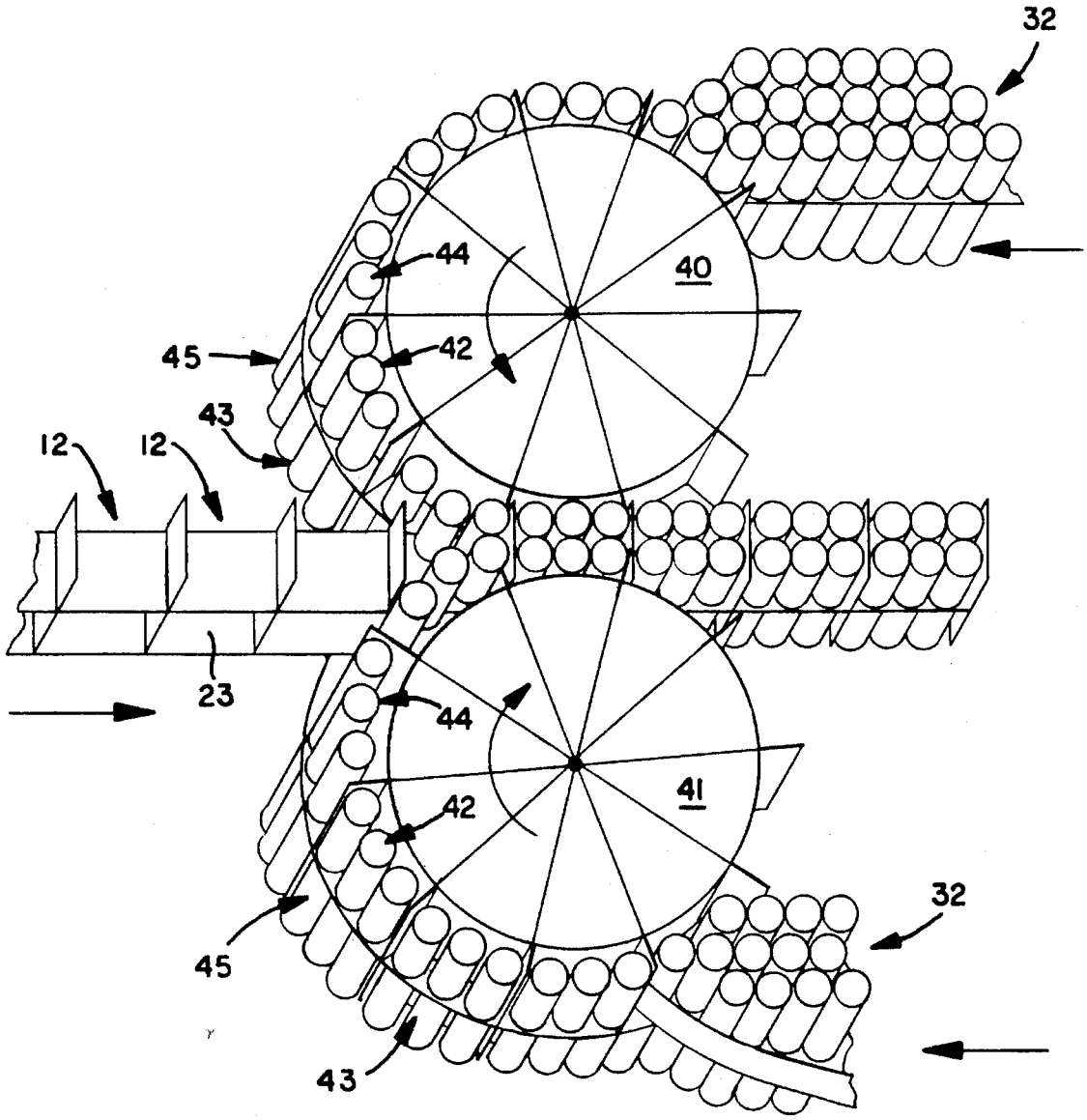
FIG. 8 shows another perspective diagram of a packaging method of the invention.

FIG. 8 shows a method of loading multilevel carton structures 12 whereby the starwheels 40 and 41 are positioned on opposite sides of the stream of opened carton structures transported on conveyor 23. Opposing streams of articles 32 are shown to be divided into upper and lower article groups 44 and 45 by the pockets 42 and 43 of starwheels 40 and 41 and which simultaneously feed the respective article groups from opposing sides into the multilevel cartons 12.

In summary, a plurality of means may be utilized to guide or move articles or article groups into multilevel carton structures. Whereas FIGS. 2 and 3 show the upper and lower article groups 25 and 26 being directed by means of a pushing and sliding process of the respective groups into the carton ends, FIG. 4 shows article groups being guided into the carton sleeve structures. Further, the first and second streams may be moved in the same plane while the conveyor or conveyor moving the open ended carton sleeve structures may have two distinct vertical levels of travel, the first being aligned with the first stream of article groups and the second being aligned with the second stream of article groups.

As many changes are possible to the processes of this invention utilizing the teachings thereof, the descriptions above, and the accompanying drawings should be interpreted in the illustrative and not the limited sense.

That which is claimed is:

1. A continuous method for packaging multilevel, stacked articles into packaging sleeves having integrally mounted divider base sheets therein comprising process steps in the sequence set forth:

a) providing a supply of generally flat and folded packaging sleeves, each packaging sleeve having a divider base sheet mounted therein and being constructed and arranged to substantially span the interior of said packaging sleeve to provide a moving sliding base for facilitating the entry of article groups into said packaging sleeve;

b) opening and positioning said packaging sleeves onto a moving conveyor system whereby said divider sheet is positioned spacially parallel said conveyor system and wherein each said packaging sleeve has at least one open end facing perpendicular the direction of movement of said conveyor system;

c) providing first and second streams of preselected article groups;

d) directing said first stream of preselected article groups through at least one open end of each said packaging sleeve and onto the bottom surface of each said packaging sleeve to thereby support said divider base sheet;

e) directing said second stream of preselected article groups through at least one open end of said packaging sleeve and onto the supported divider base sheet; and f) closing said packaging sleeves to provide a stream of stacked article packages.

2. The method of claim 1, wherein said first and second streams of preselected article groups are provided at distinct spacially removed vertical levels, said first stream being provided at a level of said packaging sleeve bottom surface and said second stream at a level of said divider sheet.

3. The method of claim 1, wherein said packaging sleeves are positioned on said moving conveyor system having opposing open ends.

4. The method of claim 3, wherein said first and second streams of preselected article groups are bifurcated streams to provide a distinct bifurcated first stream and a distinct bifurcated second stream and wherein said bifurcated first and second streams are provided on opposing sides of the packaging sleeves on said moving conveyor system.

5. The method of claim 4, wherein said bifurcated first stream of article groups is moved through opposing ends of the packaging sleeve before said bifurcated second stream of article groups is moved through the opposing ends of the packaging sleeve onto the divider sheet.

6. The method of claim 1, wherein said first and second preselected article groups are tilted and rolled into said packaging sleeve.

7. The method of claim 1, wherein method step d) further comprises pushing and sliding said first and second preselected article groups into said packaging sleeves.

8. The method of claim 1, wherein said first and second streams of article groups are provided on generally the same horizontal plane and wherein said moving conveyor system for said packaging sleeves has at least first and second vertical levels of travel, said first level of said conveyor system being aligned with said first stream of article groups and said second level of said conveyor system being aligned with said second stream of article groups.

9. A continuous method for packaging stacked articles into a packaging carton container having opposing ends and at least one divider base member extending across the interior of the packaging carton and extending between said opposing ends, comprising:

a) providing a supply of flat and folded packaging carton containers, each having said at least one divider base member, and opening said carton containers to thereby provide a stream of carton containers having at least one said opposing end in an opened configuration to expose said at least one divider base member;

b) providing a stream of articles traveling adjacent and within reach of said stream of carton containers;

c) directing articles from said article stream into said carton containers first below said divider base member to provide a supported base member and subsequently above each said supported base member; and d) closing said packaging carton end.

10. The method of claim 9, wherein said stream of articles is provided in first and second distinct streams of preselected article groups and are provided at spacially removed vertical levels, said first stream being provided at a level of said packaging sleeve bottom surface and said second stream at a level of said base member.

11. The method of claim 10, wherein said first and second streams of preselected article groups are bifurcated streams to provide a distinct bifurcated first stream and a distinct bifurcated second stream and wherein said bifurcated first and second streams are provided on opposing sides of said stream of carton containers.

12. The method of claim 10, wherein said first and second preselected article groups are tilted and rolled into said carton containers.

13. The method of claim 10, wherein said method step c)

further comprises pushing and sliding said first and second preselected article groups into said carton container.

14. The method of claim 9, wherein said first and second streams of article groups are provided on generally the same horizontal plane and wherein said stream of carton containers has at least first and second vertical levels of travel.

15. A continuous method for packaging stacked articles comprising:

a) providing a carton supply of flat and folded packaging cartons, each packaging carton having opposing sides and having a divider base sheet mounted to the interior of said opposing sides;

b) successively removing said flat and folded packaging cartons from said carton supply;

c) opening and positioning said packaging cartons onto a moving conveyor whereby said divider base sheet is positioned spacially parallel to said conveyor and wherein each said packaging carton has at least one open end facing perpendicular the direction of movement of said conveyor;

d) providing first and second streams of preselected article groups;

e) directing said first stream of preselected article groups through said at least one open end of said packaging carton and onto the bottom surface and below said divider base sheet of each said packaging carton to thereby support said divider base sheet mounted thereabove;

f) directing and sliding said second stream of preselected article groups through said at least one open end of said packaging carton and onto said supported divider base sheet; and g) closing said packaging cartons to provide a stream of stacked article packages.

16. The method of claim 15, wherein said first and second streams of preselected article groups are provided at spacially removed vertical levels, said first stream being provided at a level of said packaging carton bottom surface and said second stream at a level of said divider sheet.

17. The method of claim 15, wherein said packaging cartons are positioned on said moving conveyor having opposing open ends and wherein said first and second streams of preselected article groups are bifurcated wherein said bifurcated first and second streams are provided on opposing sides of the packaging cartons on said moving conveyor.

18. The method of claim 17, wherein said bifurcated first stream of article groups is moved through opposing ends of the packaging carton before said bifurcated second stream of article groups is moved through the opposing ends of the packaging carton onto the supported divider sheet.

19. The method of claim 18, wherein said bifurcated first and second streams of preselected article groups are angularly directed through the opposing ends of the packaging carton.

20. The method of claim 15, wherein said first and second streams of article groups are provided on generally the same horizontal plane and wherein said moving conveyor has at least first and second vertical levels of travel.

* * * * *